US006382060B1

(12) United States Patent
Eichinger

(10) Patent No.: US 6,382,060 B1
(45) Date of Patent: May 7, 2002

(54) COMBINATION PLUMBING FIXTURE AND BRACING IMPLEMENT

(76) Inventor: Alfred Eichinger, 5122 E. Sweetwater, Scottsdale, AZ (US) 85254

( * ) Notice: Subject to any disclaimer, the term of this patent is extended or adjusted under 35 U.S.C. 154(b) by 0 days.

(21) Appl. No.: 09/805,484

(22) Filed: Mar. 13, 2001

(51) Int. Cl.[7] ..... B25B 33/00
(52) U.S. Cl. ..... 81/488
(58) Field of Search ..... 81/488, 484, 423

(56) References Cited

U.S. PATENT DOCUMENTS 4,564,991 A * 1/1986 Taylor ..... 29/426.5
4,991,727 A * 2/1991 White ..... 213/20
5,285,703 A * 2/1994 Carson ..... 81/423
5,957,015 A * 9/1999 Jackson ..... 81/484

* cited by examiner

*Primary Examiner*—Joseph J. Hail, III
*Assistant Examiner*—David B. Thomas
(74) *Attorney, Agent, or Firm*—Parsons & Goltry; Michael W. Goltry; Robert A. Parsons

(57) ABSTRACT

Apparatus comprising a plumbing fixture including a channeled body having an open branch way leading to a stem way and a ferrule located in the open branch way and constructed of a first material, and an implement comprising an extension fixed to a handled body and positioned within the open branch way and through the ferrule for bracing the plumbing fixture in response to a force exerted against the handled body, wherein the extension is constructed of a second material that is softer than the first material of the ferrule for preventing the ferrule from becoming damaged in response to contact with the extension.

7 Claims, 1 Drawing Sheet

COMBINATION PLUMBING FIXTURE AND BRACING IMPLEMENT

CROSS-REFERENCE TO RELATED APPLICATION

This application claims the benefit of co-pending U.S. patent application Ser. No. 09/409,313, filed Sep. 29, 1999, entitled AN IMPLEMENT FOR BRACING A PLUMBING FIXTURE.

FIELD OF THE INVENTION

This invention relates to plumbing and to plumbing fixtures and tools.

BACKGROUND OF THE INVENTION

Plumbing comprises the pipes, fixtures, and other apparatus of a water, gas, or sewage system of a building. Installing plumbing apparatus must be carefully done, for it can prove difficult and expensive to fix leaks after the building construction is complete. One of the most important features of plumbing installations is the angle valve. Angle valves provide the means for directing the flow of gas, water or sewage through the building. Although the prior art is replete with various specialized tools designed to hasten and ensure proper plumbing fixture installation, little effort has been directed toward improved apparatus specifically designed to hasten angle valve installation and to improved angle valve constructions and associated useful combinations. Given this deficiency in the art, the need for certain new and useful improvements is evident.

SUMMARY OF THE INVENTION

The above problems and others are at least partially solved and the above purposes and others realized in a new and improved apparatus comprising, in combination, a plumbing fixture comprising a channeled body having an open branch way leading to a stem way and a ferrule located in the open branch way and constructed of a first material, and an implement comprising an extension fixed to a handled body and positioned within the open branch way and through the ferrule for bracing the plumbing fixture in response to a force exerted against the handled body. The extension is constructed of a second material that is softer than the first material of the ferrule for preventing the ferrule from becoming damaged in response to contact with the extension and this is an essential feature of the invention. In this embodiment, the extension is fixed apart from, and substantially parallel to, a face of the handled body, and comprises an elongate sleeve constructed of the second material and supported by an elongate member fixed to the handled body.

In another useful embodiment, the invention proposes apparatus comprising a plumbing fixture comprising a channeled body having an open branch way leading to a stem way and a ferrule located in the open branch way and constructed of a first material, and an implement comprising an extension fixed to a handled body in opposition to a face of the handled body, the face positioned against the plumbing fixture and the extension positioned within the open branch way and through the ferrule for bracing the plumbing fixture in response to a force exerted against the handled body. The extension is constructed of a second material that is softer than the first material of the ferrule for preventing the ferrule from becoming damaged in response to contact with the extension and this is an essential feature of the invention. In this embodiment, the extension is substantially parallel to the face and comprises an elongate sleeve constructed of the second material and supported by an elongate member fixed to the handled body.

In yet another useful embodiment, the invention proposes a method comprising steps of a)providing a plumbing fixture comprising a channeled body having an open branch way leading to a stem way and a ferrule located in the open branch way and constructed of a first material, b)providing an implement comprising an extension that is i)constructed of a second material that is softer than the first material and ii)fixed to a handled body, c)positioning the extension within the open branch way and through the ferrule, and d)bracing the plumbing fixture by exerting a force against the handled body. Because the extension is constructed of a second material that is softer than the first material of the ferrule, the ferrule is prevented from becoming damaged in response to contact with the extension and this is an essential feature of the invention.

BRIEF DESCRIPTION OF THE DRAWINGS

The foregoing and further and more specific objects and advantages of the invention will become readily apparent to those skilled in the art from the following detailed description taken in conjunction with the drawings in which.

DETAILED DESCRIPTION OF A PREFERRED EMBODIMENT

Figure 1:
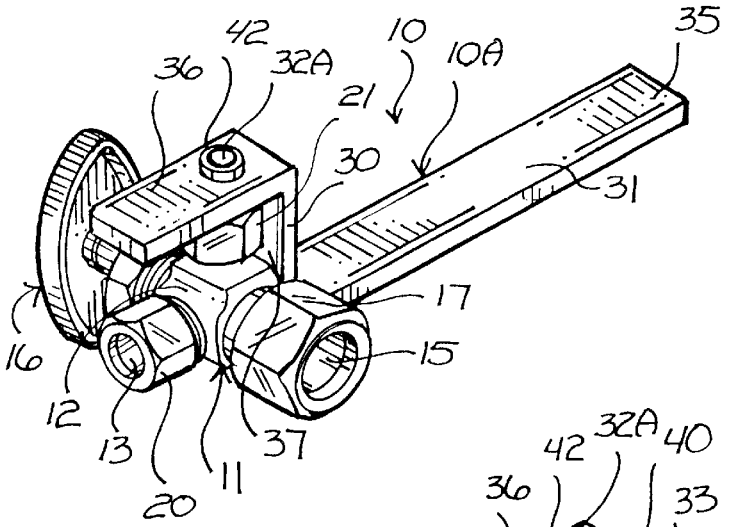
FIG. 1 is a perspective view of apparatus comprising a plumbing fixture and an attached implement, in accordance with the invention.
Figure 3:
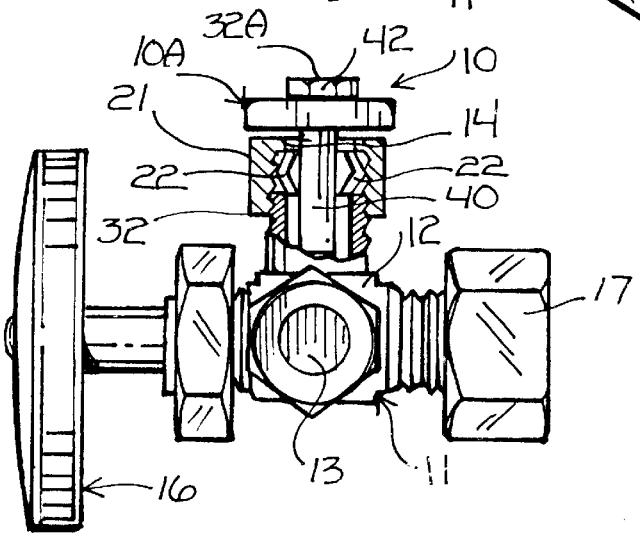
FIG. 3 is a side view of the apparatus of FIG. 1, with portions thereof broken away for illustration.

Turning to the drawings, in which like reference characters indicate corresponding elements throughout the several views, attention is first directed to FIG. 1, which illustrates apparatus 10 comprising a plumbing fixture, namely, an angle valve 11, and an attached implement 10A, in accordance with the invention. Angle valve 11 is adapted and arranged for regulating the passage of liquid, especially water, and comprises a channeled body 12 that defines open branch ways 13 and 14 leading to a stem way 15. Angle valve 11 may include two branch ways as shown, one branch way or more than two branch ways if desired. Body 12 supports a valve 16 for regulating the flow of liquid through the stem way 15 and the branch ways 13 and 4. A nut 17 is threadably engaged to or otherwise carried by a threaded opening 18 leading to stem way 15. After passing a liquid-supply conduit into and through threaded opening 18, nut 17 may be threadably engaged to threaded opening 18 and then tightened for sealingly engaging the liquid supply conduit to the threaded opening 18. A ferrule is positioned at threaded opening 18 and sealed against the liquid supply conduit upon the tightening of nut 17 for effecting exemplary sealing engagement in accordance with standard practice. Branch ways 13 and 14 define open free ends, and normally carry threadably engaged nuts 20 and 21, respectively. After passing liquid conduits into and through the open free ends of the branch ways 13 and 14, respectively, nuts 20 and 21 may be tightened for sealingly engaging the liquid conduits to the respective open free ends. Ferrules are positioned at the open free ends and sealed against the liquid conduits upon the tightening of nuts 20 and 21, respectively, for effecting exemplary sealing engagement in accordance with standard practice. In FIG. 3, such a ferrule 22 is shown captured by nut 21 at the open free end of branch way 14. Nuts 17, 20 and 21 are each open at two ends.

Figure 2:
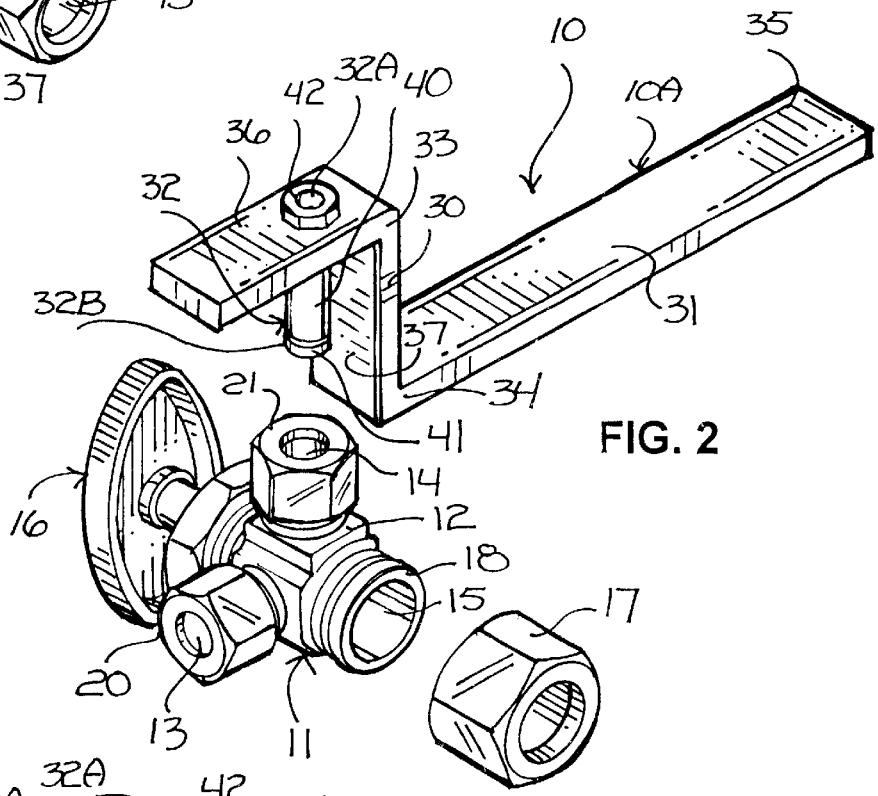
FIG. 2 is a partial exploded perspective view of the apparatus of FIG. 1.

Regarding FIG. 2, implement 10A is constructed of strong plastic, one or more selected metals or other material, and is comprised of three main parts including an elongate element 30, a handle 31 and an extension 32. Elongate element 30 defines opposing ends 33 and 34 and a length, and supports handle 31, which extends in a direction away from end 34 at a substantial right angle to elongate element 30. Handle 31 defines an outer or distal extremity 35 and a length sufficient so that it may be easily grasped by a human hand. Extension 32 depends from an arm 36 that extends away from end 33 of elongate element 30 in a direction that is opposite to the direction handle 31 extends. Extension 32 defines a proximal extremity 32A fixed to arm 36, a free distal extremity 32B, and is positioned apart from and substantially parallel to a face 37 of elongate element 30. Extension 32 also defines a size or diameter, which allows it to be inserted into and through one or both of the branch ways 13 and 14 by way of their nuts 20 and 21 and free ends, respectively. Elongate element 30, handle 31 and arm 36 cooperate to define a handled body.

In a plumbing installation, stem way 15 is coupled to a liquid supply conduit before coupling the branch ways 13 and 14 with their respective liquid conduits. An aggressive rotational force must be applied to nut 17 to tighten it for providing a sealing engagement of threaded opening 18 to the liquid supply conduit. The use or manipulation of a standard wrench is normally employed for engaging nut 17 and introducing this rotational force. As the rotational force is applied, angle valve 11 will also normally rotate. To prevent angle valve 11 from rotating, it is necessary to seize the angle valve with a second wrench, which can not only damage the angle valve, but also prove difficult in the tight spaces at which angle valves are typically installed. Nevertheless, the combination of implement 10A attached to angle valve 11 in accordance with the invention is a useful combination, which solves these problems.

In accordance with the invention, extension 30 is attached to angle valve 11 and, more particularly, is positioned within branch way 14 by way of its open free end and nut 21 as shown in FIG. 3. By grasping handle 31, a user may exert forcible measures thereagainst for moving and bracing angle valve 11, before and during an installation procedure and otherwise for bracing angle valve 11 against forcible measures exerted against angle valve 11 or to a feature of angle valve 11, such as a threadably attached nut. The positioning and attachment of extension 32 at branch way 14 and the simultaneous positioning of the handled body in or at a fixed attitude cooperate to define a bracing or braced condition of apparatus 10. In response to this braced condition, angle valve 11 is resistant to rotational movement upon application of a rotational force to nut 17. The attachment of implement 10A to angle valve 11 also includes the engagement of face 37 of elongate element 30 to an external surface of angle valve 11. The combination of angle valve 11 and implement 10A is also foreseeable in connection with branch way 13, in accordance with the invention.

Extension 32 is welded to arm or otherwise fixed to arm 36 in any suitable manner, and preferably defines an exterior surface constructed of a material softer than ferrule 22 shown in FIG. 3. This is an essential feature of the invention, as it prevents ferrule 22 from becoming damaged in response to contact with the exterior surface of extension 32. Regarding FIG. 2, the disclosed embodiment of extension 32 is comprised of an elongate sleeve 40. An elongate member 41 extends through sleeve 40 and through arm 36, and is fixed or retained to arm 36 by welding or other fastening mechanism, or perhaps with an engagement element 42. In this embodiment, elongate member 41 and engagement element 42 together comprise the rigid support structure that supports sleeve 40. Elongate member 41 is headed for effecting a capturing of sleeve 40 in cooperation with elongate element 30. Elongate member 41 may comprise a bolt, and engagement element 42 may comprise a nut or other suitable fastener. Other similar structure for supporting sleeve 40 may be employed. In a specific example, ferrule 22 is constructed of brass. Accordingly, sleeve 40 may therefore be constructed of copper or other material that is softer than brass.

The invention has been described above with reference to one or more preferred embodiments. However, those skilled in the art will recognize that changes and modifications may be made in the described embodiments without departing from the nature and scope of the invention. Various changes and modifications to one or more of the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. Apparatus comprising:

a plumbing fixture comprising a channeled body having an open branch way leading to a stem way and a ferrule located in the open branch way and constructed of a first material; and an implement comprising an extension fixed to a handled body and positioned within the open branch way and through the ferrule for bracing the plumbing fixture in response to a force exerted against the handled body;

wherein the extension is constructed of a second material that is softer than the first material of the ferrule for preventing the ferrule from becoming damaged in response to contact with the extension.

2. Apparatus of claim 1, wherein the extension is fixed apart from, and substantially parallel to, a face of the handled body.

3. Apparatus of claim 1, wherein the extension comprises an elongate sleeve constructed of the second material and supported by an elongate member fixed to the handled body.

4. Apparatus comprising:

a plumbing fixture comprising a channeled body having an open branch way leading to a stem way and a ferrule located in the open branch way and constructed of a first material; and an implement comprising an extension fixed to a handled body in opposition to a face of the handled body, the face positioned against the plumbing fixture and the extension positioned within the open branch way and through the ferrule for bracing the plumbing fixture in response to a force exerted against the handled body;

wherein the extension is constructed of a second material that is softer than the first material of the ferrule for preventing the ferrule from becoming damaged in response to contact with the extension.

5. Apparatus of claim 4, wherein the extension is substantially parallel to the face.

6. Apparatus of claim 4, wherein the extension comprises an elongate sleeve constructed of the second material and supported by an elongate member fixed to the handled body.

7. A method comprising steps of:

providing a plumbing fixture comprising a channeled body having an open branch way leading to a stem way and a ferrule located in the open branch way and constructed of a first material;

providing an implement comprising an extension fixed to a handled body;

positioning the extension within the open branch way and through the ferrule; and bracing the plumbing fixture by exerting a force against the handled body;

wherein the extension is constructed of a second material that is softer than the first material of the ferrule for preventing the ferrule from becoming damaged in response to contact with the extension.

* * * * *